US010486053B2

(12) United States Patent
Schulte

(10) Patent No.: US 10,486,053 B2
(45) Date of Patent: Nov. 26, 2019

(54) DEVICE AND METHOD FOR PROPERLY LOCATING THE YARDLINE NUMBERS OF A FOOTBALL FIELD

(71) Applicant: Technology Licensing Corp., Cincinnati, OH (US)

(72) Inventor: Samuel Schulte, Cincinnati, OH (US)

(73) Assignee: Technology Licensing Corp., Newtown, OH (US)

( * ) Notice: Subject to any disclaimer, the term of this patent is extended or adjusted under 35 U.S.C. 154(b) by 0 days.

(21) Appl. No.: 15/339,976

(22) Filed: Nov. 1, 2016

(65) Prior Publication Data

US 2018/0117451 A1 May 3, 2018

(51) Int. Cl.

| | |
|---|---|
| ***A63B 67/18*** | (2016.01) |
| ***A63C 19/06*** | (2006.01) |
| ***A63B 61/00*** | (2006.01) |
| ***A63B 71/06*** | (2006.01) |
| *A63B 63/00* | (2006.01) |
| *A63B 69/00* | (2006.01) |
| *A63B 69/34* | (2006.01) |

(52) U.S. Cl.
CPC ..... *A63C 19/065* (2013.01); *A63B 71/06* (2013.01); *A63B 63/00* (2013.01); *A63B 69/002* (2013.01); *A63B 69/0071* (2013.01); *A63B 69/345* (2013.01); *A63B 2071/0694* (2013.01); *A63B 2243/007* (2013.01)

(58) Field of Classification Search
CPC ..... B43L 13/208; A63C 19/065; A63B 71/06; A63B 2071/0694; E01C 13/08
USPC ..... 473/490; 33/26, 563, 564; 40/595, 618; 428/131
See application file for complete search history.

(56) References Cited

U.S. PATENT DOCUMENTS 147,942 A * 2/1874 Hutchinson ..... B43L 13/208 33/564
557,003 A * 3/1896 Myers, Jr. ..... A63F 9/12 273/156
1,593,353 A * 7/1926 Pollock ..... B05C 17/06 33/564

(Continued)

OTHER PUBLICATIONS

Yrdline Number Stencils and USSC Football Field Stencils.*

*Primary Examiner* — Mitra Aryanpour
(74) *Attorney, Agent, or Firm* — Wood Herron & Evans LLP

(57) ABSTRACT

A template for properly determining the positions for the yardline numbers of an American-style football field includes a generally rectangular frame having an external perimeter and an internal opening defined by an internal perimeter. The shape of the internal opening, and the corresponding shape of the internal perimeter, is such that for each of the yardline numbers, i.e. 5, 4, 3, 2, 1, and 0, the internal perimeter defines a plurality of locations for abutting a corresponding plurality of outer edge portions of the yardline number. With the external perimeter appropriately aligned along one or more lines of the field, the frame can be used to properly locate any one of the six yardline numbers that are needed to properly locate all of the yardline numbers on an American-style football field. This frame reduces the number of templates needed to locate the yardline numbers of a football field, and also simplifies the process of properly locating the yardline numbers.

24 Claims, 15 Drawing Sheets

(56) References Cited

U.S. PATENT DOCUMENTS 1,797,035 A * 3/1931 Wilson ..... B05C 17/06 33/564
1,824,643 A * 9/1931 Warren ..... A63B 71/0672 40/598
3,181,865 A * 5/1965 Tout ..... A63F 3/00041 273/240
3,354,567 A * 11/1967 Philbin ..... G09F 7/00 40/598
3,371,647 A * 3/1968 Shopbell ..... A63C 19/062 116/209
3,375,588 A * 4/1968 Pelham ..... B43L 13/02 33/438
3,491,196 A * 1/1970 Stein ..... A63F 9/0098 273/156
3,634,961 A * 1/1972 Nawalaniec ..... A63C 19/08 40/598
3,837,317 A * 9/1974 Hanauer ..... G09F 9/40 116/311
4,103,886 A * 8/1978 Eley ..... A63C 19/065 404/12
4,185,392 A * 1/1980 Berkman ..... B43L 13/208 33/564
4,274,459 A * 6/1981 Galajda ..... B23Q 35/42 144/144.1
4,392,306 A * 7/1983 Johnstone ..... B43L 13/208 33/564
4,468,862 A * 9/1984 Barnhill ..... B43L 13/20 33/563
4,580,352 A * 4/1986 Wilson ..... E04F 21/26 33/478
4,852,483 A * 8/1989 Bussard ..... B41F 15/02 101/114
4,972,598 A * 11/1990 Charters, Jr. ..... B43L 13/208 33/564
4,989,341 A * 2/1991 Scotese ..... A63B 71/0605 33/759
5,000,688 A * 3/1991 Clamp ..... G09B 11/04 101/127
5,280,921 A * 1/1994 Milburn ..... G01B 3/11 33/756
5,331,744 A * 7/1994 Rumsey ..... B43L 13/20 33/18.1
5,396,713 A * 3/1995 Valdez ..... A63F 9/001 33/562
5,519,940 A * 5/1996 Brondfield ..... A63C 19/065 33/1 G
6,012,228 A * 1/2000 Fisanich ..... G01B 3/11 33/289
6,709,350 B1 * 3/2004 Onstad ..... A63C 19/08 33/1 G
6,829,990 B2 * 12/2004 Cochran ..... B41L 13/10 101/127.1
7,347,142 B2 * 3/2008 Fields ..... A01G 1/00 101/127
7,721,776 B2 * 5/2010 Justin ..... B27C 5/06 33/562
D641,267 S * 7/2011 Kozina ..... B27F 5/12 D10/64
D809,597 S * 2/2018 Kalia ..... D19/59
2006/0102023 A1 * 5/2006 Rivera ..... B05C 17/06 101/127
2017/0106392 A1 * 4/2017 Kehoe ..... B05B 15/045 118/504

* cited by examiner

DEVICE AND METHOD FOR PROPERLY LOCATING THE YARDLINE NUMBERS OF A FOOTBALL FIELD

FIELD OF THE INVENTION

The present invention relates to a device and method for properly locating the yardline numbers of an American football field, particularly an infilled artificial turf football field.

BACKGROUND OF THE INVENTION

In recent years, infilled artificial turf has become increasingly more popular in the United States as a playing surface for organized sports, particularly football. A typical infilled artificial turf includes a horizontal backing, often called a primary, grasslike fibers extending upwardly from the backing, and particulate infill located on the backing and within and amongst the grasslike fibers. The infill supports the fibers in a generally upright position. Typically, the particulate infill material may include sand, crumb rubber, which may be ambiently or cryogenically ground, or a combination of sand and rubber. Other materials also may be used, such as materials considered to be more environmentally safe, such as water-repelling, non-compacting, and non-mounding beads of the type disclosed in U.S. Pat. No. 8,034,429.

A standard U.S. football field includes a number of conventional and widely recognized markings. These markings identify various places on the field, such as the goal line, the side lines, the yardlines, etc. The dimensions of all U.S. football fields are the same. That is, they are 100 yards (300 feet) long, i.e. between one goal line and the opposite goal line, and the widthwise dimension, i.e. from one sideline to the other sideline, is 53.3 yards (160 feet). There are also hash mark lines that extend the length of the field, with one hash mark line on each side. Generally, at least for college and high school football fields, the hash marks are wider than the span of the goal posts located at the rears of the opposing end zones.

The present invention relates to the numbering of the yardlines for such a field. More specifically, each side of the field bears a yardline number every 10 yards. This means that when viewed from the sideline, the yardline numbers appear as follows: 10, 20, 30, 40, 50, 40, 30, 20, 10. Also, on the side of the yardline number that is nearest to the closest goal line, the field typically shows one arrow, or small triangle.

Currently, when a typical infilled artificial turf football field is initially installed, there are no yardline numbers already in place. Instead, those parts of the field typically are green. On the other hand, the initially installed field will typically already include the sidelines, the end lines, the yardlines, and the goal lines.

One option for adding the yardline numbers to a football field would be to paint the turf, at the outset, at the specific locations where the yardline numbers are to be located. However, painted yardline numbers are susceptible to wearing away, and thereby require subsequent paint applications. Such subsequent paint applications can damage the artificial turf fibers, and may also present a health risk to athletes playing on the surface. In fact, one recent NFL preseason game had to be cancelled because of concerns related to painted portions of an artificial turf. For these and other reasons, it has become common to insert into an infilled artificial turf football field the separately produced, colored yardline numbers, as described below.

More particularly, according to the most common manner of adding the yardline numbers to a field, the manufacturer of the artificial turf typically sends to the field site a set of yardline numbers that are already permanently colored white, or some other non-green color designated for the yardline numbers. Each of these already-colored artificial turf yardline numbers then becomes placed at the proper location on the turf, pinned in the proper location, and then the correspondingly sized section of the initial turf residing below is cut and removed, leaving an empty section shaped like the number shape that was removed. Thereafter, each of the colored yardline numbers is secured in place within the initial turf, by adhering the underside edge portion of the yardline number to the adjacently located underlying edges of the initially installed turf, via an underlapped connector. This fills in the empty section where the turf has been cut and removed. In other words, the permanently colored yardline numbers are substituted for the cut-out portions of the initially laid artificial turf. The green cut-out portions, which have the same shapes as the corresponding yardline numbers, are not used.

In order to properly locate the colored yardline numbers in the correct position and orientation, the field installer will typically measure the proper distance from the sideline and/or the hash marker, and then extend a string, or line, along the length of the field. This longitudinal temporary line, along with the closest actual yardline, is then used to properly locate a specific yardline number template on the field. For example, to form the yardline number "10" the installer will first use a "1" template on the left side of the ten yardline, and then use a "0" template on the right side of the ten yardline, thereby to form the complete number "10" for the 10 yardline.

Because each of the number-specific templates has a size that must be larger than the size of the corresponding number, by necessity these templates are relatively large. For example, the numbers are typically 4'×6', while the number "1" is 3'×6', and the corresponding templates are typically about 7' in length and about 6' in width and have an opening that is specifically shaped to abut the entire outer edge of one particular number. Also, these templates are usually made of aluminum. This inherent size issue, and the composition of the templates, increases the time, the cost, and the inconvenience of numbering a football field.

With a number-specific template located in the correct place on the field, the field installer places the corresponding single digit yardline number within the opening of the template, and then pins the yardline number to the top of the initial installed turf and removes the template. This enables the installer to thereafter cut the in place turf that is located directly below the outer edge of the pinned down white (or neutral) yardline number. Once that cut portion of the initial field has been removed, the white (or neutral) yardline number can then be secured into place, typically by adhering, i.e. gluing, the colored yardline number to the adjacently located portion of the field, via a lapped underlying piece with adhesive on its upper surface, to secure to the bottom edges of the yardline number and the adjacently located sections of the initially installed turf.

According to this approach the field installer uses six different number specific templates to install a typical American football field, i.e. one for each of the digits 0, 1, 2, 3, 4, and 5. Moreover, for each yardline the correct colored yardline numbers need to be correctly matched up with the correct templates, i.e. a digit of 1 through 5 plus a 0. Eventually all six of the number specific templates are used at specific locations on the field. More specifically, each of the non-zero number templates is used twice, on diagonally opposite locations of the field, while the "0" template is used eighteen times.

Thus, the current state of the art with respect to adding the yardline numbers to a football field requires the installing crew to have and to maintain at least one complete set of the number-specific templates, i.e. at least six templates in total. Due to the need to travel to the field itself and store the templates when not in use, the templates generally get beaten up over time. Moreover, due to the carrying of the templates to multiple sites on the field during the numbering process, the use of multiple yardline numbering templates adds to the time, the cost, and the inconvenience of installing a football field.

SUMMARY OF THE INVENTION

It is an object of the present invention to reduce the time and costs associated with properly locating the yardline numbers of an artificial turf field.

It is another object of the present invention to reduce the amount of labor and equipment needed to locate the yardline numbers for a football field.

It is still another object of the invention to simplify the process of properly locating the yardline numbers for an artificial turf American-style football field.

The present invention achieves the above-stated objects via a generic or universal yardline number template which comprises a frame having an internal perimeter that is shaped so as to readily enable a user to identify the proper location for each of the yardline numbers needed to number a football field. This enables the field installer to use one single template for each of the six yardline numbers, i.e. 1, 2, 3, 4, 5, and 0. In other words, the internal perimeter has a shape that accommodates the outer dimensions of each of the six different yardline numbers.

According to one aspect of the invention, the specific positions of the internal perimeter which correspond to a particular yardline number can be marked with indicia, such as color coding, to further assure correct placement of each number in the proper position with an opening within the frame.

According to a preferred embodiment of the invention, the template is generally a frame that is rectangular in shape, with an outer perimeter that is at least in part alignable along an existing line of the field and/or along a longitudinal temporary line spaced from the hash mark of the field. The frame preferably is of uniform thickness, and has an internal opening that is defined by the internal perimeter. The internal perimeter and the corresponding internal opening, is shaped and sized to locate the edges of each of the yardline numbers, and to do so in a manner such that there is only one place to properly locate the yardline number. The number "1" represents an exception to this general rule, because it is narrower than the other five numbers. Nonetheless, the template can be further modified, if desired, to assist the user in identifying the proper location for the number "1."

This invention reduces the time needed to add the yardline numbers to a football field because the same template can be used to properly locate the yardline numbers at each numbering site. Thus, there is no need to move two number-specific templates to each yardline numbering site on the field. Nor is there a need to store and then regularly ship multiple templates to every field site. One template does the job.

In addition, a portion of the outer perimeter of the template can also be adapted to receive and to properly locate the field "arrow" which points toward the goal line.

These and other features of the present invention will be more readily understood when considered in the context of the drawings. The next section of this specification briefly describes the accompanying drawings, while the section thereafter describes those same drawings in further detail.

BRIEF DESCRIPTION OF THE DRAWINGS

FIG. 4B shows a yardline number 36 located above and in alignment with the internal opening 30, while

As noted above, FIGS. 2 and 3 are presented in color.

DETAILED DESCRIPTION OF THE DRAWINGS

Figure 1:
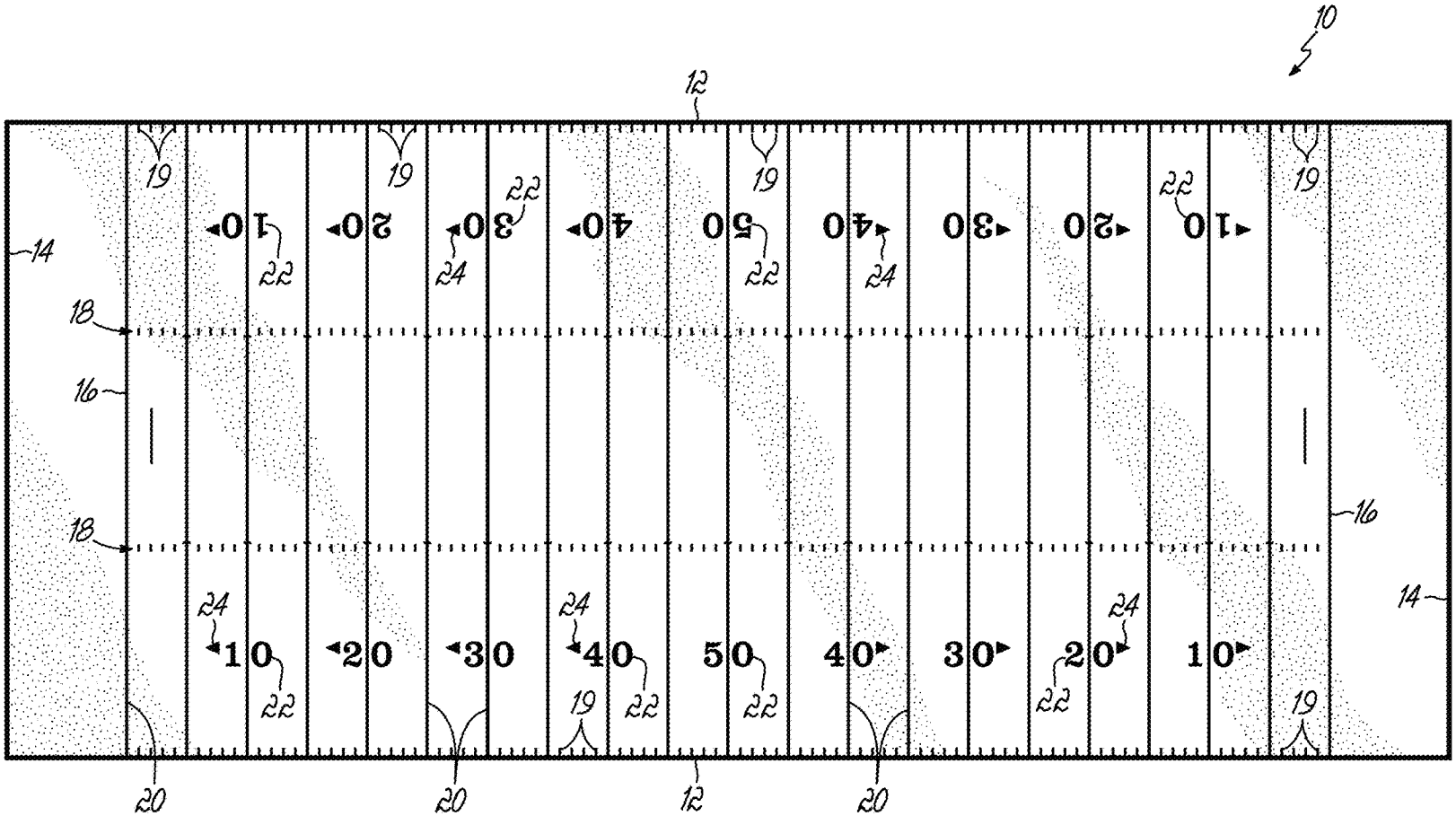
FIG. 1 is a plan view of a conventional field used for American-style football, showing the yardline and the yardline numbers.

FIG. 1 shows a conventional U.S. style football field 10, with typical football field markings included thereon. This includes opposing sidelines 12, end lines 14 which demarcate the distal ends of the oppositely located end zones, and opposing goal lines 16. These markings essentially frame the field of play. FIG. 10 also shows a pair of hash lines 18 which are parallel and which run the length of the field. In actuality, the hash lines are not longitudinal lines per se. Rather, they represent a series of aligned hash marks, with one hash mark for each yard of the field, in which the playing field is 100 yards long. Along the sidelines, there are sideline hash marks 19.

In between the goal lines 16, the field 10 includes a plurality of yardlines 20 which extend across the entire width of the field. These yardlines 20 appear every five yards of the field. As shown in FIG. 1, a typical American-style football field includes yardline numbers 22 to mark the yardlines which are multiples of ten, i.e., every ten yards of the field. This means that when the field is viewed from either side, the viewer sees, starting from the left, the 10 yardline, then the 20 yardline, and then successively the 30, 40, 50, 40, 30, 20, and then the opposite 10 yardline. A viewer from the opposite side of the field sees the same numbers. Each yardline number represents the distance, in yards, to the nearest goal line, and the 50 yardline represents halfway between the two opposing goal lines 16. In addition to the yardline numbers 22, the football field also includes arrows 24 which are located adjacent to the yardline numbers 22 and which point to the nearest goal line 16.

Figure 2:
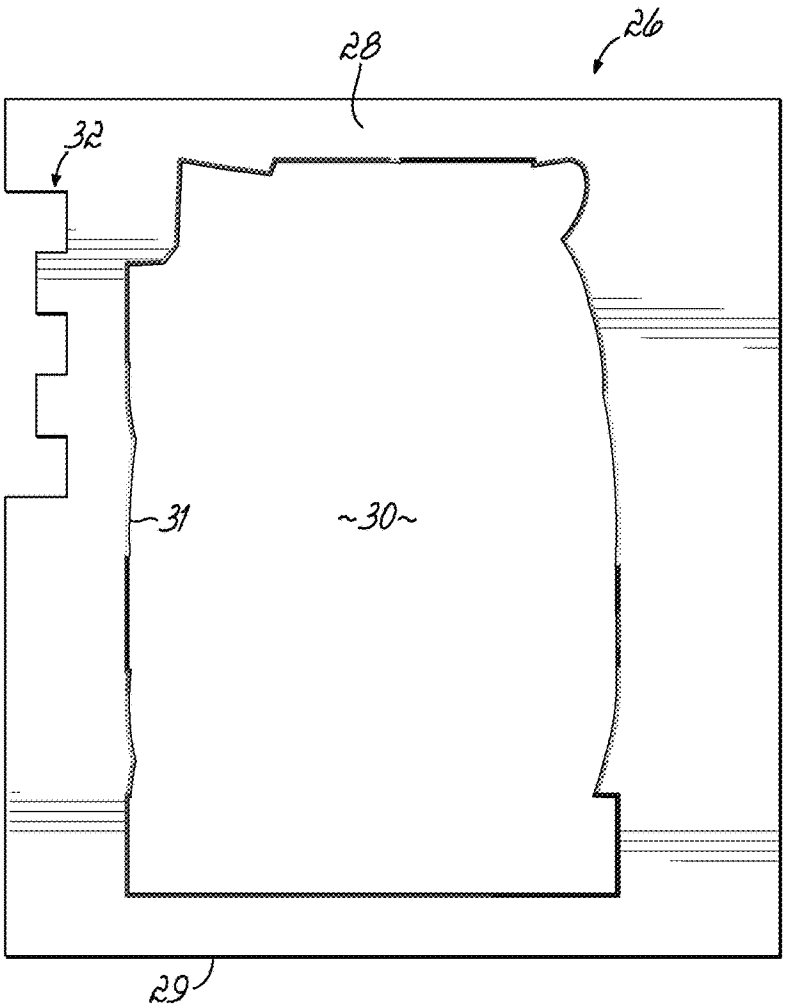
FIG. 2 is a plan view of a football field yardline numbering template according to a preferred embodiment of the present invention, with no numbers shown therein, but with colors on the internal perimeter to show locations for abutting outer edge portions of a particular yardline number.

FIG. 2 shows a yardline number template 26 according to a preferred embodiment of the present invention. More particularly, FIG. 2 shows a frame 28 defined by an external perimeter 29 and an internal opening 30 which is defined by an internal perimeter 31. The external perimeter 29 is generally rectangular in shape, except for a section 32 that is shaped like a jigsaw and which is located near the upper left side of the frame 28. The internal opening 30 defined by the internal perimeter 31 of the frame 28 is sized to properly locate each of the yardline numbers needed to mark the yardline numbers on the football field 10. More specifically, for each yardline number, the irregular shape of the internal perimeter 31 defines a plurality of locations for abutting a corresponding plurality of the outer edge portions of the yardline number when located within the opening 30. And this is true with respect to each of the six yardline numbers used to number the field 10.

Figure 3:
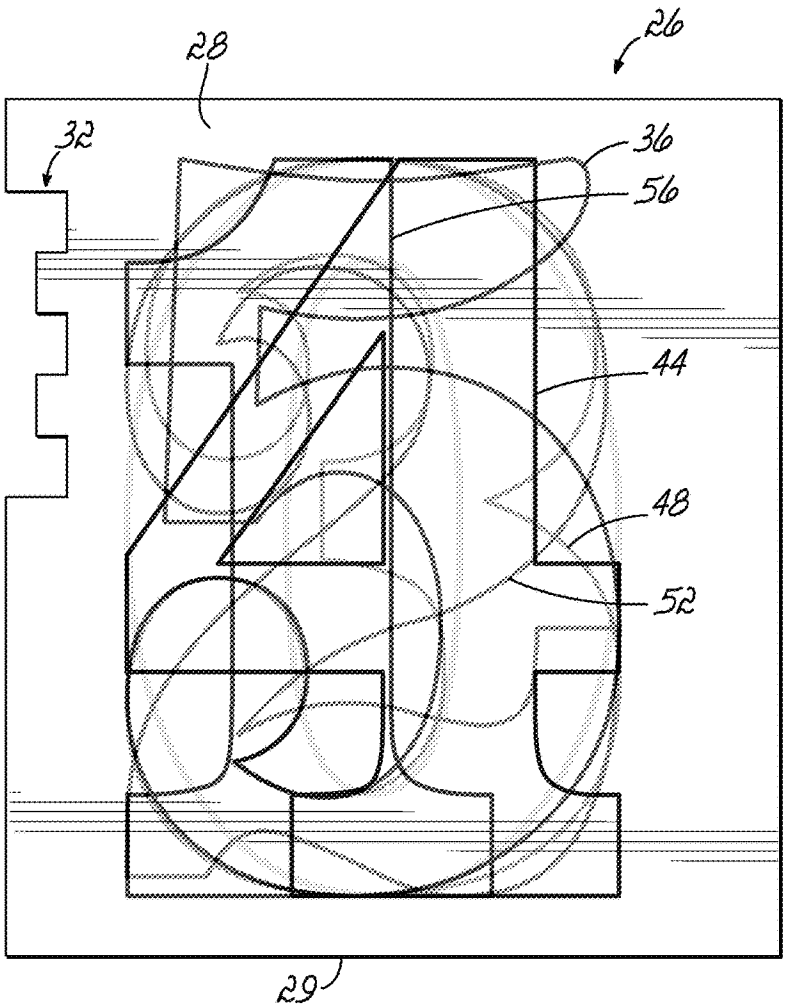
FIG. 3 is a plan view, similar to FIG. 2, of the yardline numbering template of the present invention, but with each of the six yardline numbers shown superimposed over each other, in color, within the opening defined by the frame.

In FIG. 2 each color shows the locations of a particular yardline number, and this is shown more clearly in FIG. 3, which shows each of the yardline numbers located within the opening 30, but in superimposed condition in different colors. More specifically, in FIG. 3 each of the numbers is shown in a different color, and the internal perimeter 31 shows corresponding different colors. These colors can be used to help in properly locating each yardline number in the proper position within the opening 30. As an alternative to using colors, the frame 28 could use another type of indicia, or even printed instructions. The particular shape of the internal perimeter 31, and hence the internal opening 30, was achieved by successively superimposing, in a digital database, all of the yardline numbers and then outlining the superimposed numbers to create a perimeter defined by the outermost or external-most edge portion of the superimposed yardline numbers. The use of the template 26 is further explained below. Those skilled in the art will appreciate that while the perimeter of these FIG. 31 is font specific, other fonts could also be used.

Figure 4:
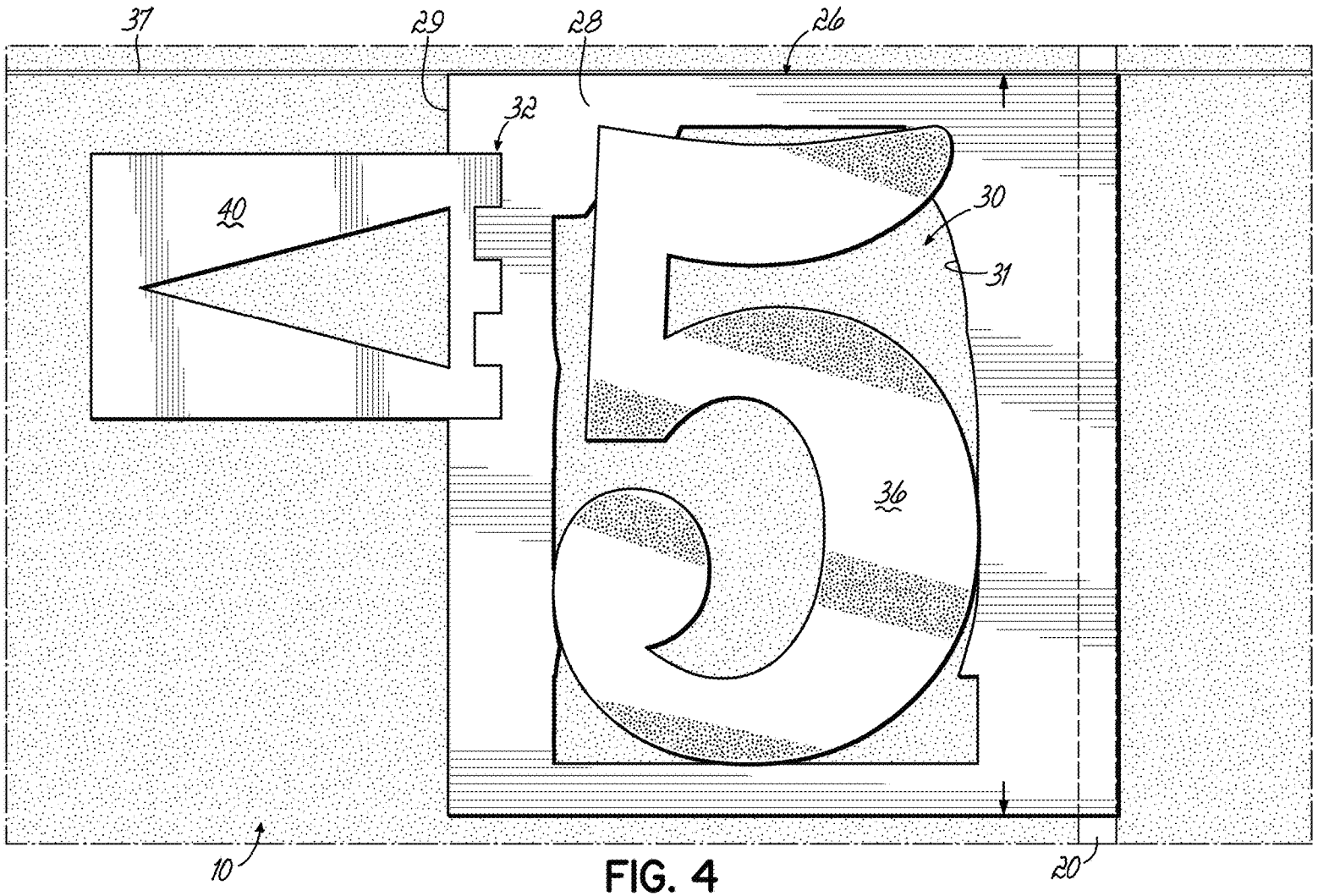
FIG. 4 shows the yardline numbering template of the present invention as used to locate the yardline number "5."

More specifically, FIG. 4 shows the 5 yardline number 36 located within the opening 30 of the frame 28, wherein the frame 28 is located such that the longitudinal edge of the outer perimeter 29, on the right side, is aligned with the furthest portion of the actual yardline of the field. Moreover, the upper edge of the outer perimeter 29 of the frame is aligned with a temporary line 37 that has been placed on the field 10, as measured from the closest hash mark 18. As shown in FIG. 4, the 5 yardline number 36 has an outer edge which abuts against the internal perimeter 31 in several locations. The abutting relationship may be along a straight line, a curve, a corner, or some combination of a straight line, a curve, and a corner. In FIG. 4 this contact occurs at the bottom (a curve), at the lower left (a curve), at the upper left (a corner), at the upper right (a curve), and at the lower right (a curve). Thus, the edges of the 5 yardline number abut the internal perimeter 31 at five locations.

FIG. 4 also shows the arrow template 40 located within the designated location defined by surface 32 located at the upper left part of the frame 28. The arrow template 40 properly locates a corresponding arrow section 41 of the field.

Figure 4A:
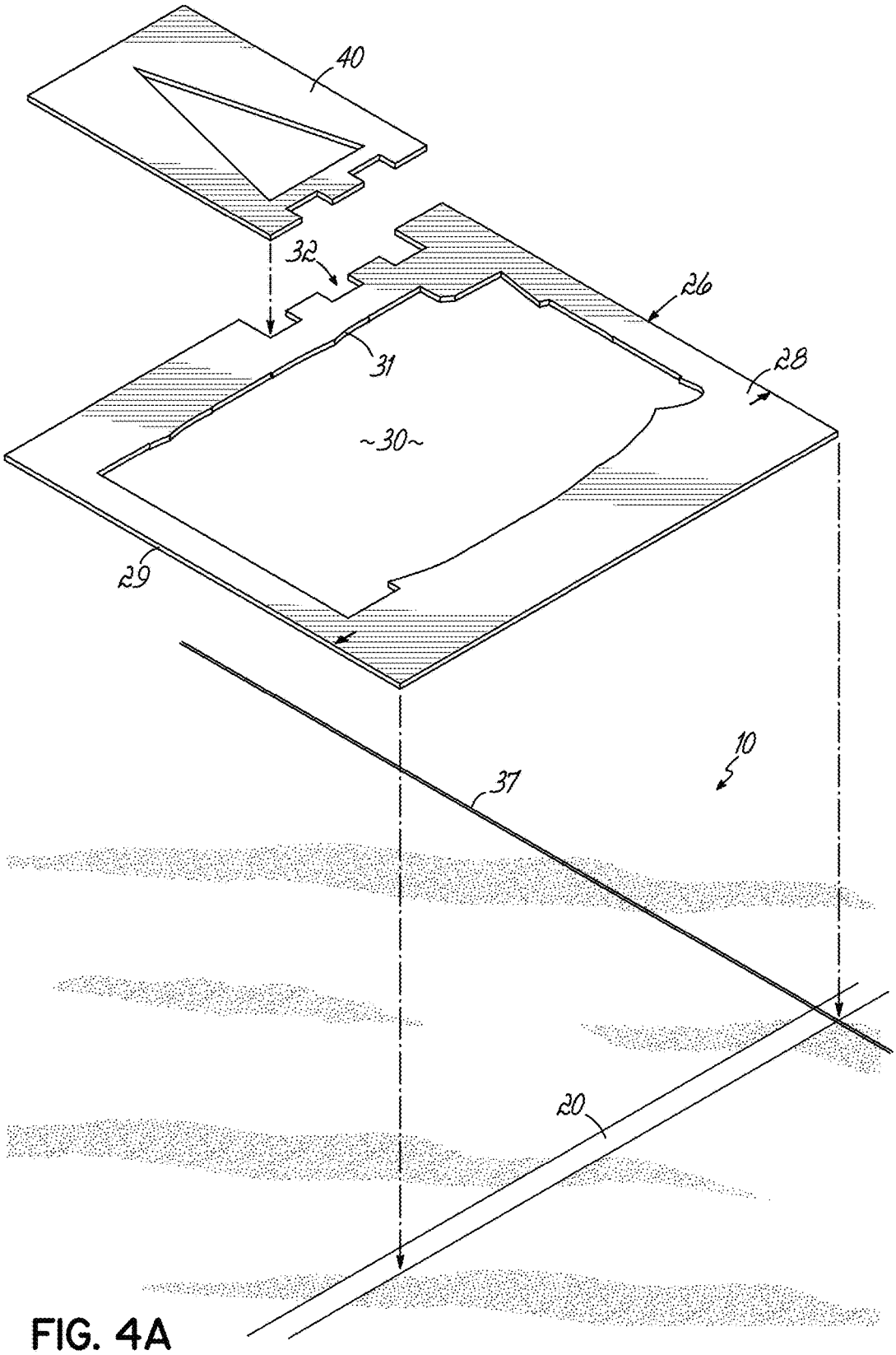
FIG. 4A shows the location and orientation of template 26 with respect to yardline 20 and temporary line 37, with template 40 also shown.
Figure 4B:
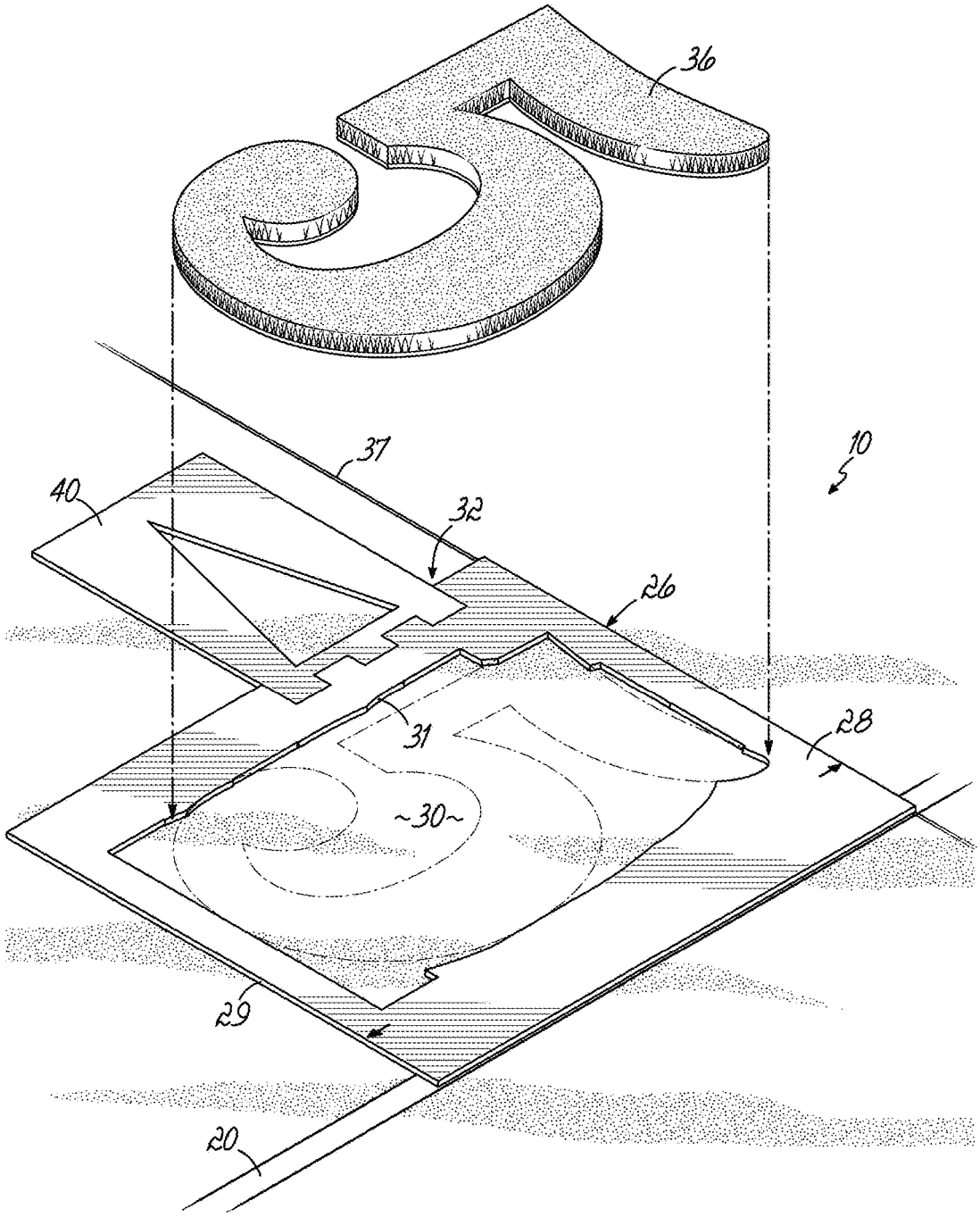
Figure 4C:
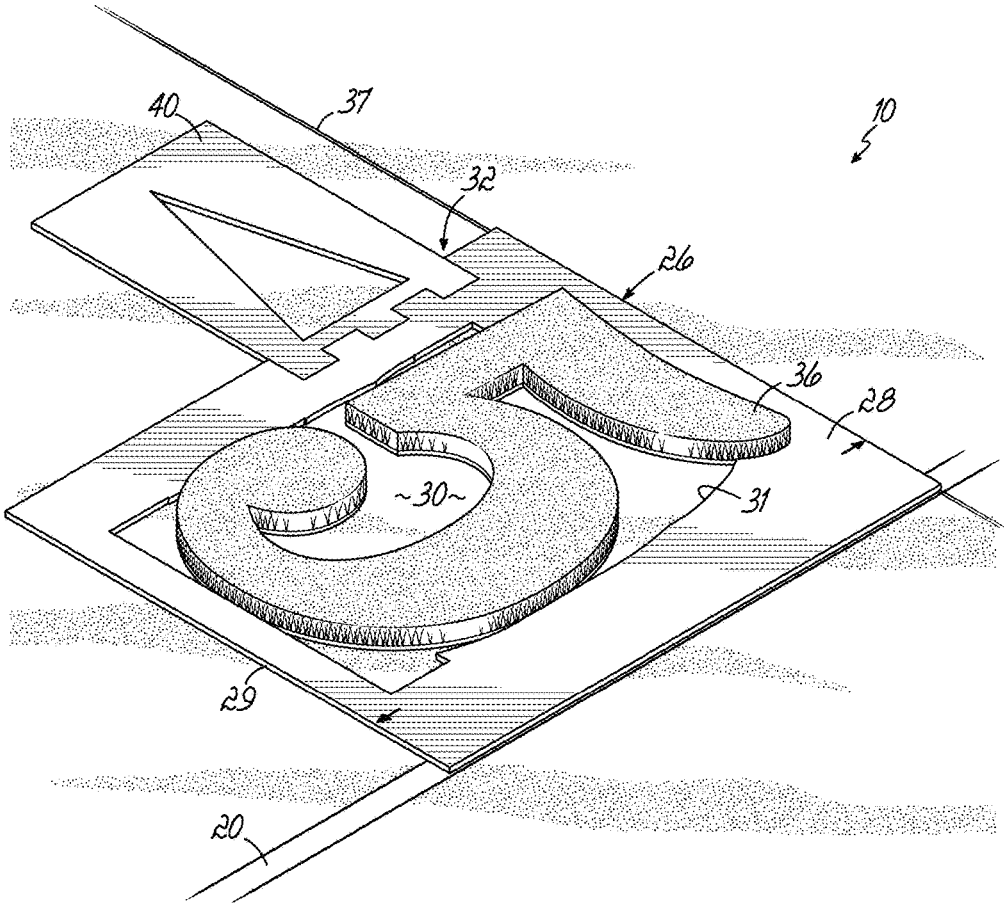
FIG. 4C shows the yardline number 36 in place within the opening 30, for pinning and then cutting.
Figure 4D:
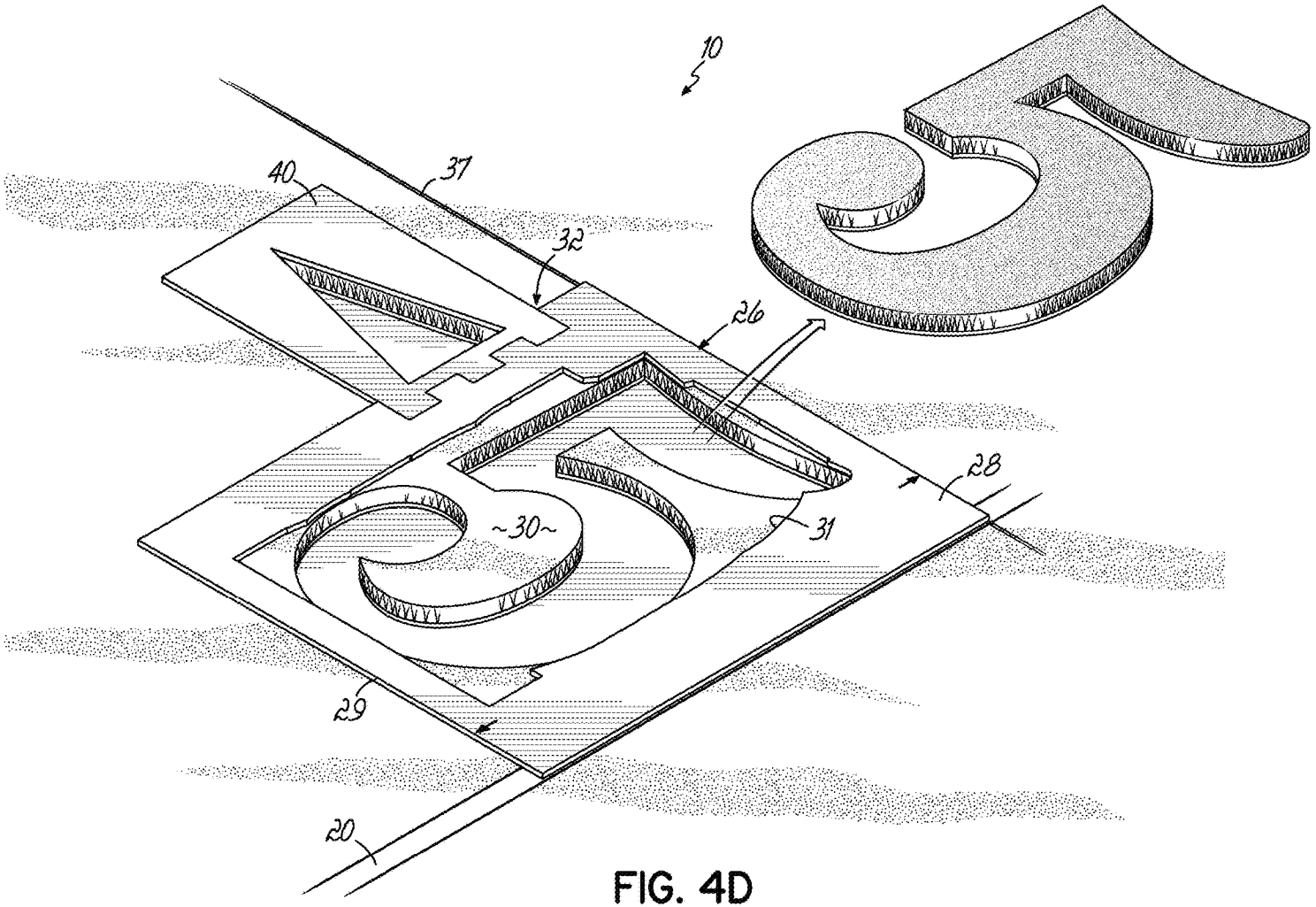
FIG. 4D schematically shows the original turf, in the shape of a "5" that has been removed after cutting, while FIG. 4E schematically shows the yardline number 36 now aligned with its eventual position on the turf, and also the arrow 41.
Figure 4E:
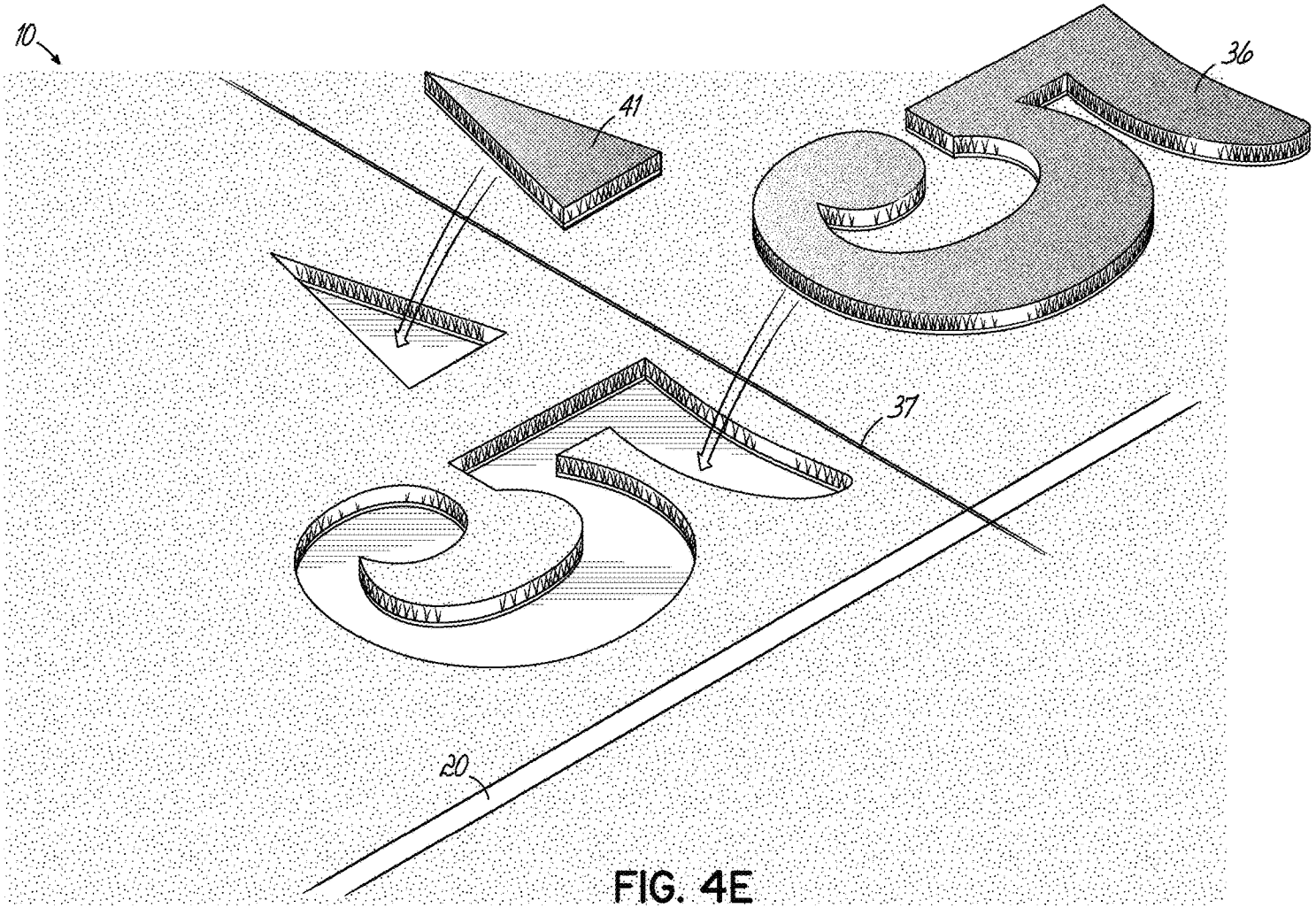
Figure 4F:
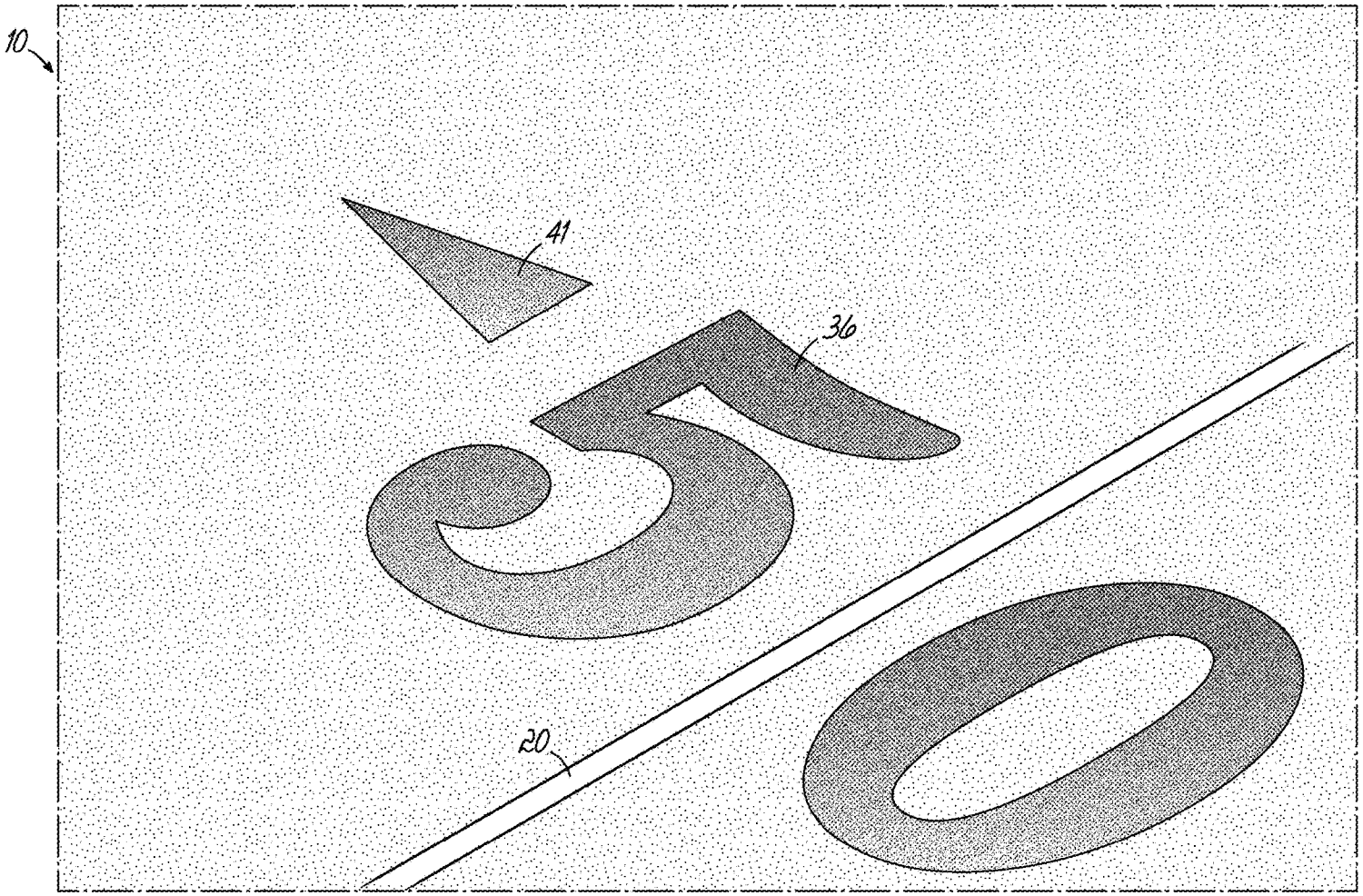
FIG. 4F shows yardline number 36 and arrow 41 in place on the field.

FIGS. 4A-4F show a typical sequence used to place the yardline number 36 in the field. More particularly, FIG. 4A schematically shows the template 26 and the arrow template 40 ready to be placed on the field. FIG. 4B shows the templates 26 and 40 on the field, with the yardline number 36 schematically shown thereabove. FIG. 4C shows yardline number 36 in place for pinning and cutting the original turf from thereunder. As described earlier, it is typical to remove the template 26 prior to cutting the initial turf to allow better access thereto. FIG. 4D shows removal of the original turf, while FIG. 4E schematically shows yardline number 36 and arrow 41 located above their respective positions. And finally, FIG. 4F shows the yardline number 36 and the arrow 41 in their appropriate positions of the field.

It should be understood that FIGS. 4A-4F are exemplary with respect to the location of the arrow 41, in combination with the depiction of the yardline number "5," because with most fields no arrows are used at the 50 yardline. After all, it is the middle of a U.S. football field. Nonetheless, the template location shown in these Figure shows, where the arrow 41 is located relative to the template 26 when locating the arrow for each of the 10, 20, 30, and 40 yardlines.

Figure 5:
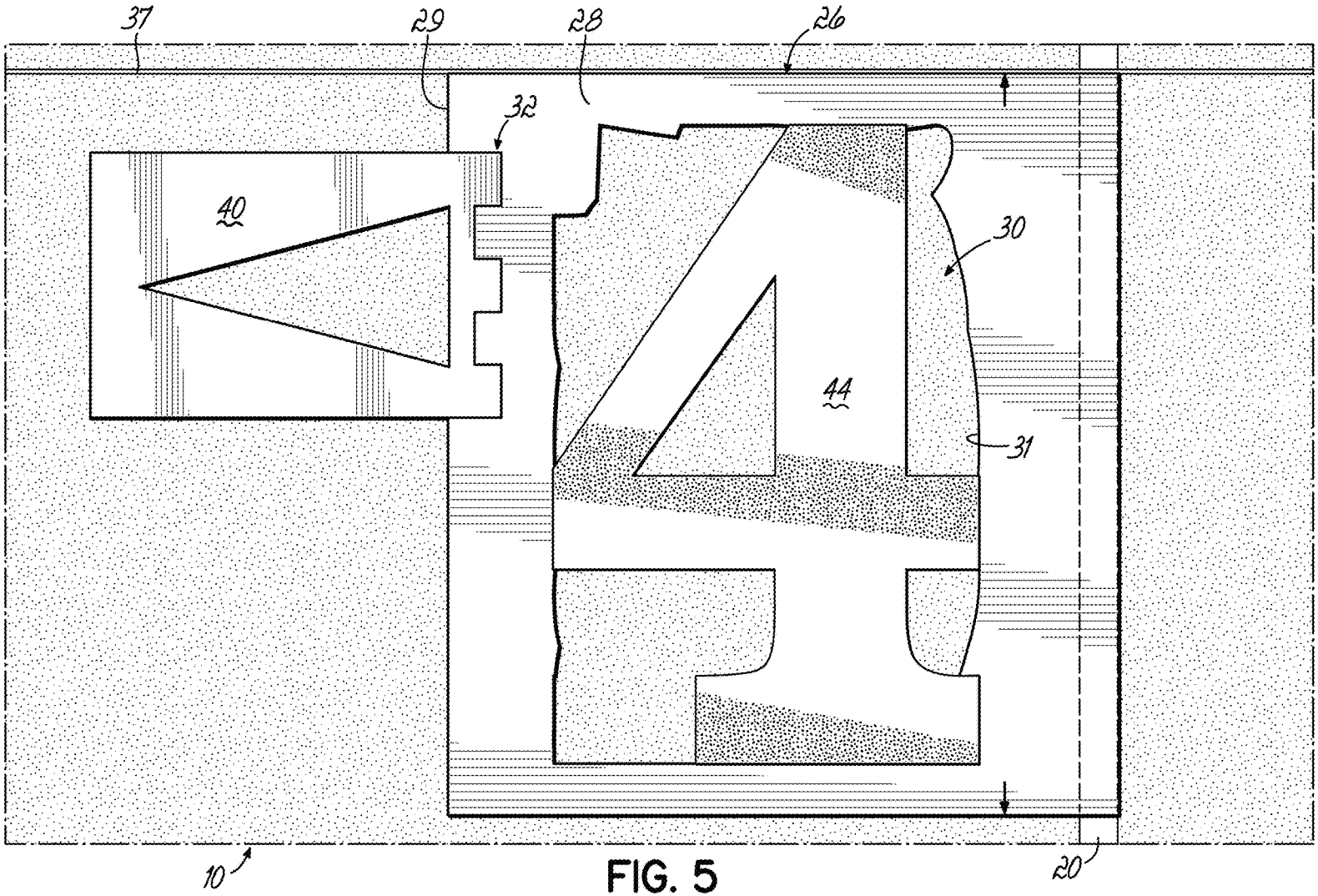
FIG. 5 shows the yardline numbering template of the present invention as used to locate the yardline number "4."

Similarly, FIG. 5 shows 4 yardline number 44 located within the opening 30, with edge portions abutting corresponding sections of the internal perimeter 31. Again, the longitudinal right side edge of the frame 28 is located along the sideline, and the top edge thereof is located along line 37. Moreover, arrow template 40 is again shown in place. With respect to the 4 yardline number 44 itself, it abuts the internal perimeter 31 at four locations of edge abutment, namely, the bottom (three straight lines which define a corner and also include the lower right), the left side (a straight line), the top (a straight line), and the right side (another straight line).

Figure 6:
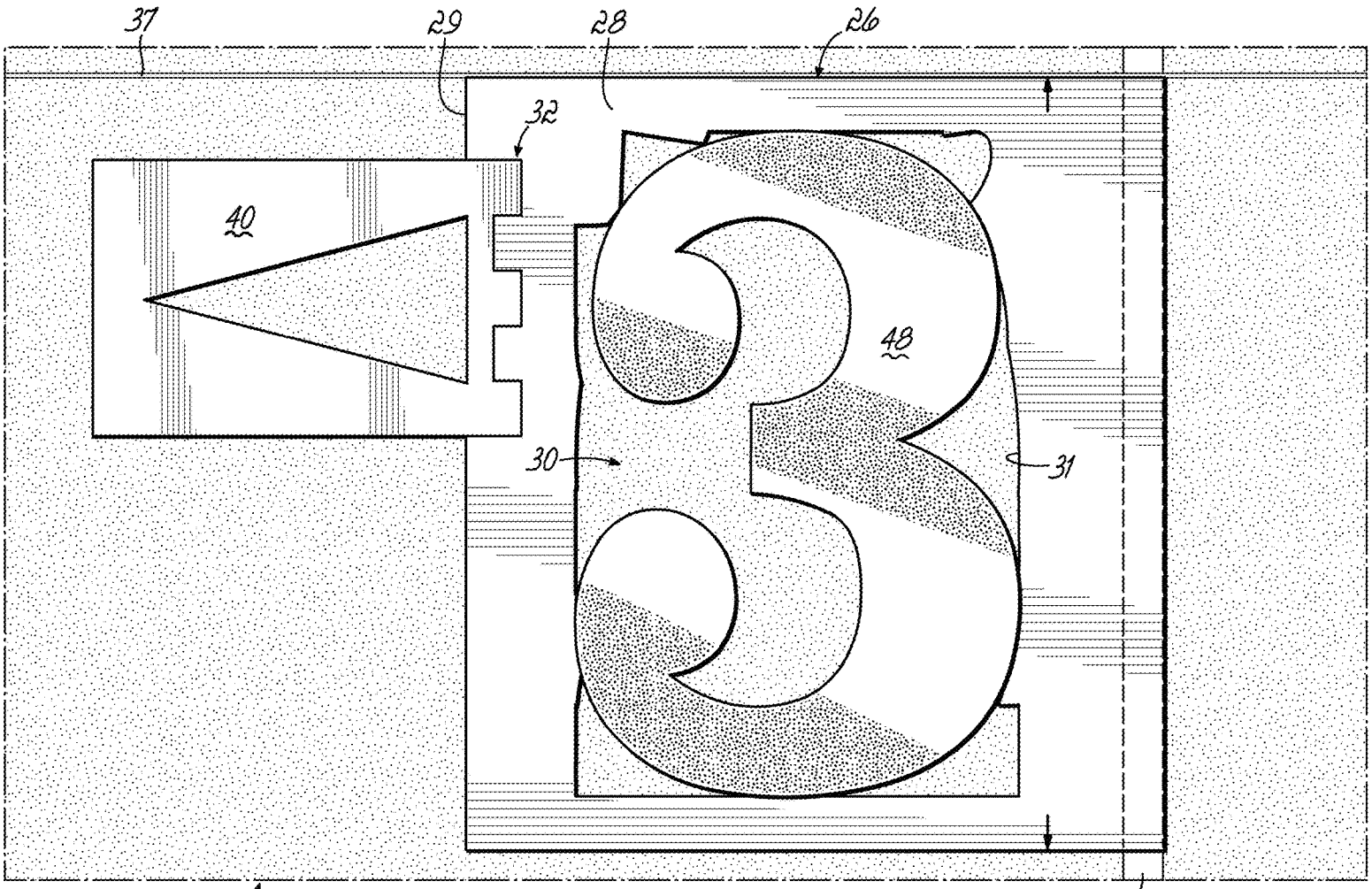
FIG. 6 shows the yardline numbering template of the present invention as used to locate the yardline number "3."

FIG. 6 shows a 3 yardline number 48 located within the opening 30 defined by internal perimeter 31, and with outer edge portions thereof abutting a plurality of locations of the internal perimeter 31, namely at the bottom (a curve), the lower left (a curve), the upper left (a curve), the upper left again near the top (a curve), the top (a curve), the upper right near the top (a curve), and the lower right (a curve). Thus, the 3 yardline number 48 includes seven locations of edge abutment.

Figure 7:
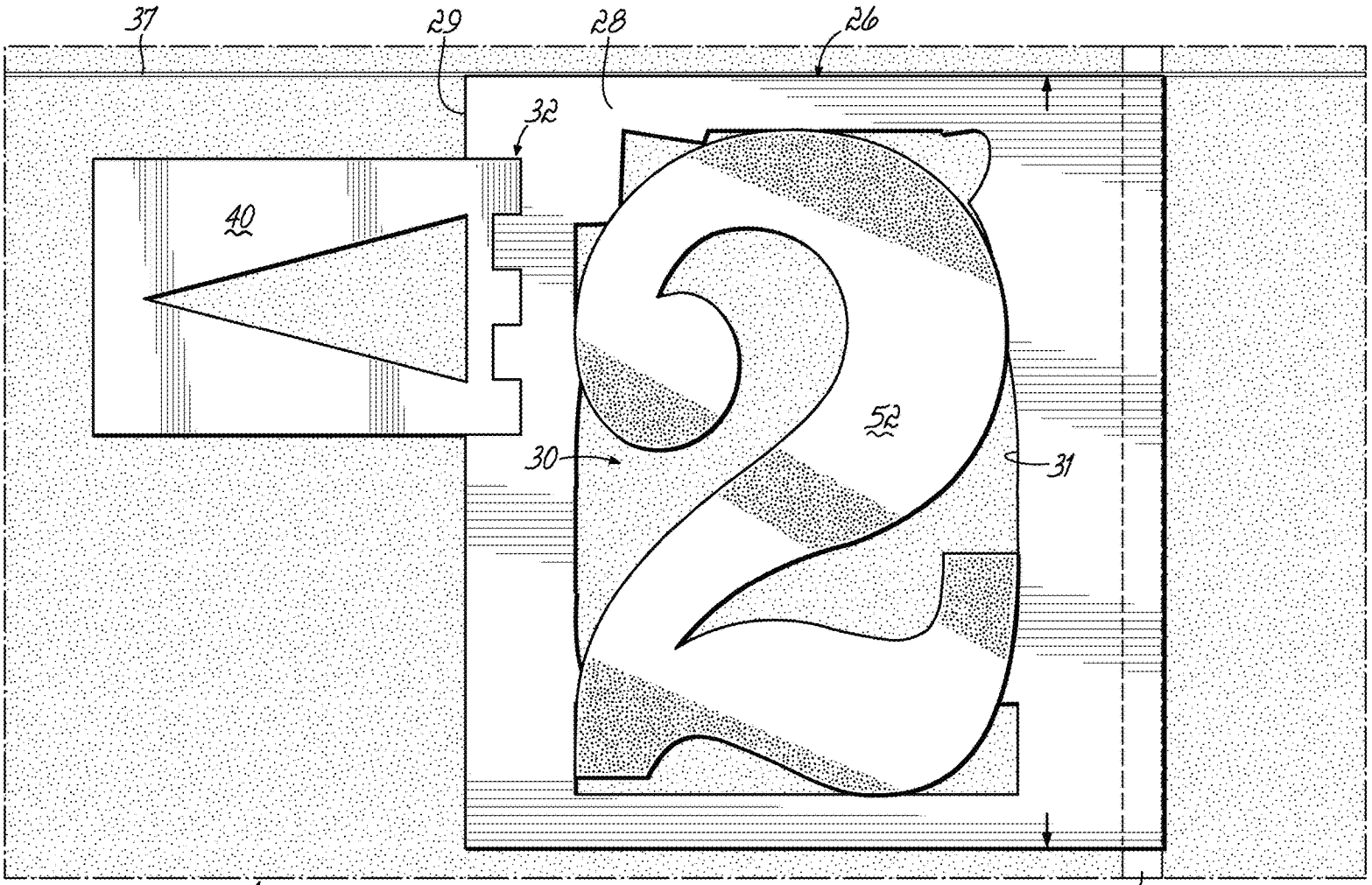
FIG. 7 shows the yardline numbering template of the present invention as used to locate the yardline number "2."

FIG. 7 shows the 2 yardline number 52, again located within the opening 30 defined by the internal perimeter 31. The 2 yardline number 52 contacts the internal perimeter 31 at the bottom right (a curve), lower left (a curve), upper left (a curve), upper left again (a curve), top left (a point), top (a curve), upper right (a curve), and lower right (a curve). Thus, there are eight edge abutting locations.

Figure 8:
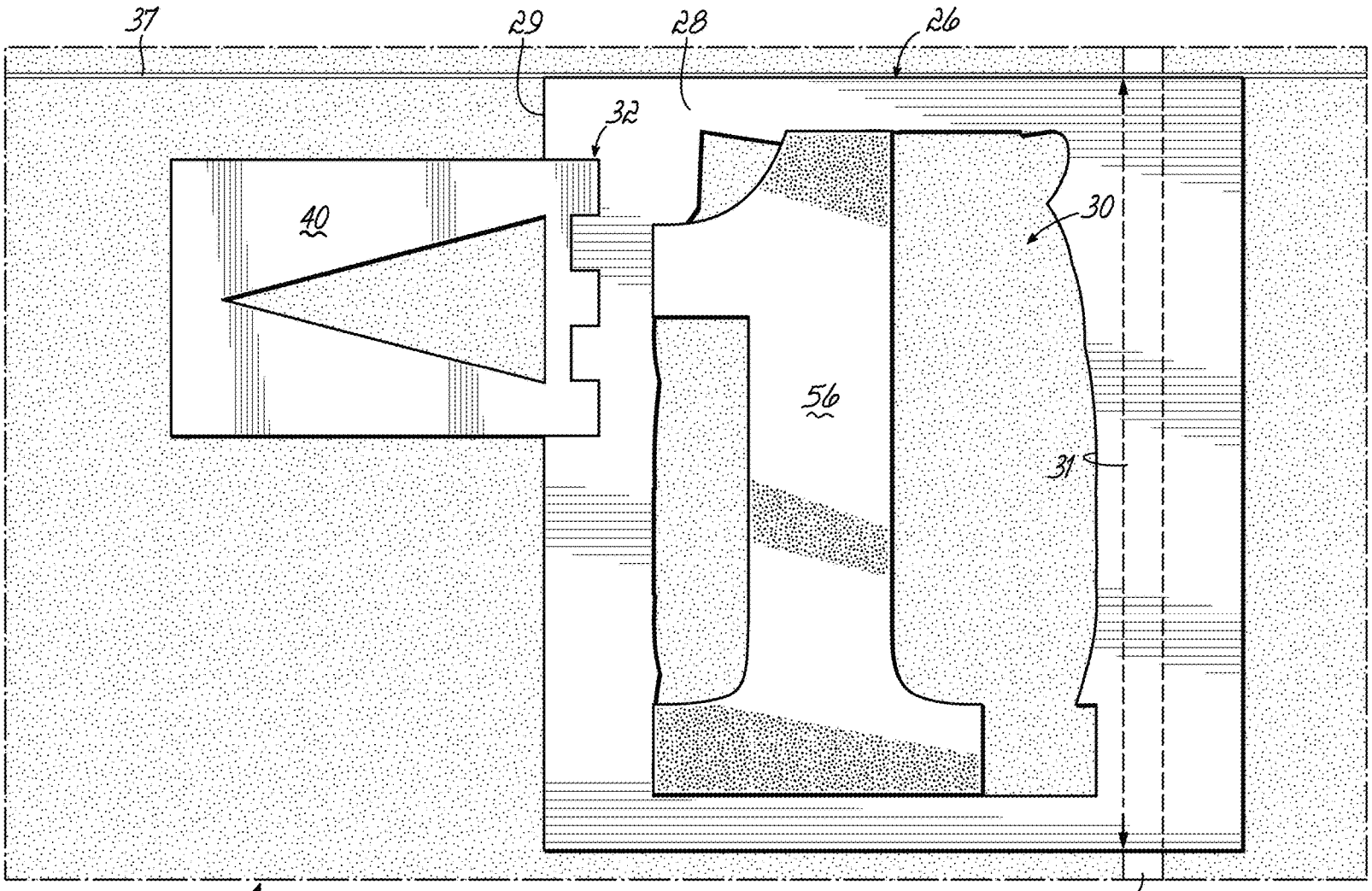
FIG. 8 shows the yardline numbering template of the present invention as used to locate the yardline number "1."

FIG. 8 shows the 1 yardline number 56 located within the opening 30 defined by the internal perimeter 31. In contrast to the other non-zero digits, the number 1 is significantly thinner, with a reduced widthwise dimension. For that reason, the frame 28 is offset relative to the yardline 20, to the right. Indicator arrows at the top and bottom of the template 26 show the user where to align the template 26 with the yardline 20. Also, the top edge of the outer perimeter is again aligned along temporary line 37. With the frame 28 located in this position, as understood by those skilled in the art, the 1 yardline number 56 is located at the left-most portion of the opening 30, in an offset position, with contact points at the bottom left (a corner), upper left (corner with a curve at the top), and the top (another curved corner), and therefore three locations of edge abutment.

Figure 9:
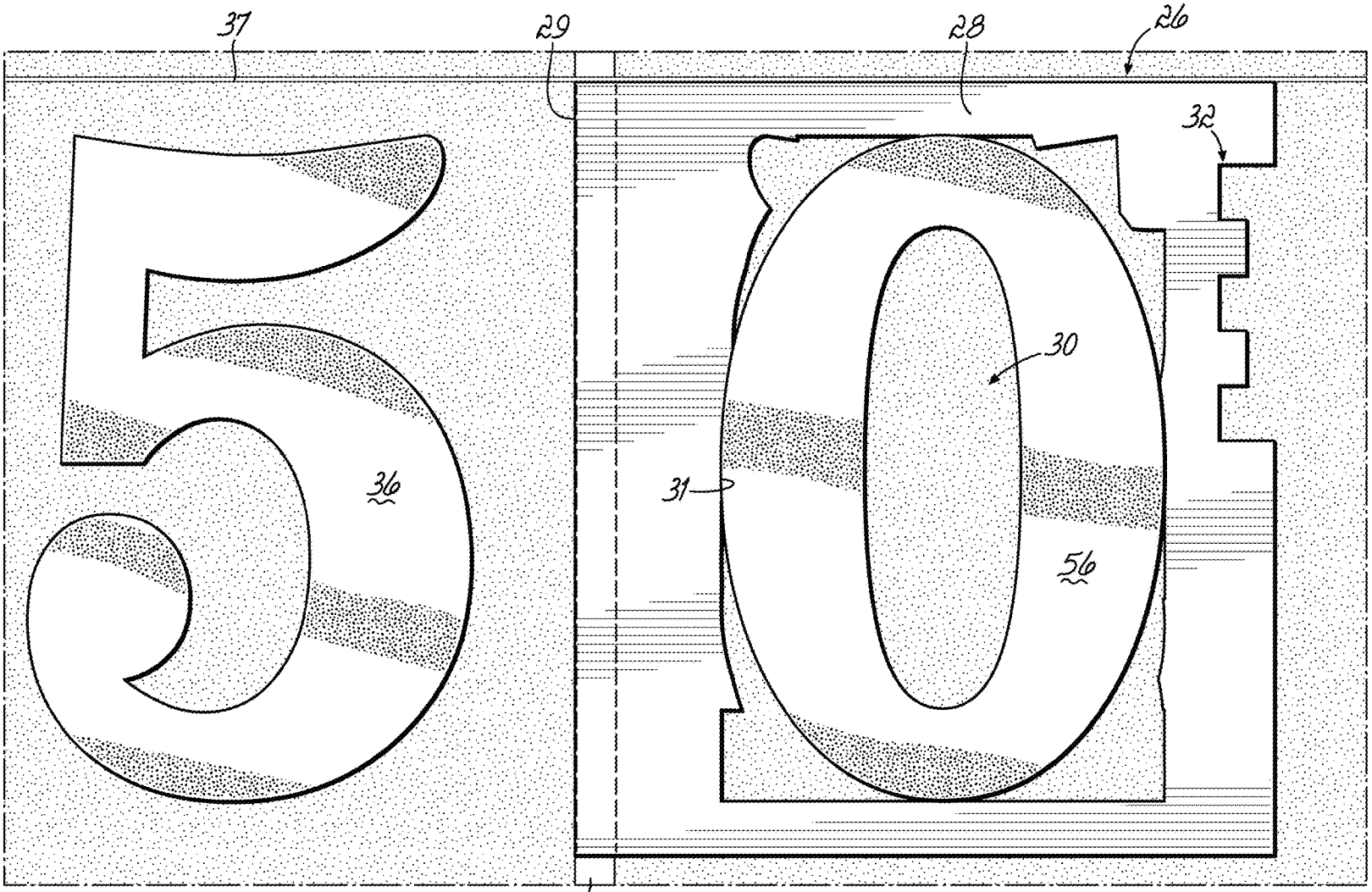
FIG. 9 shows the yardline numbering template of the present invention as used to locate the yardline number "0."

FIG. 9 shows the 0 yardline number 60 located on the right side of the nearest yardline. Essentially, to form the "0" yardline number, the template 26 is flipped over the nearest yardline (i.e. turned like a page, with respect to the yardline), to locate the "0" on the right side thereof. As shown in FIG. 10, the 0 yardline number abuts the internal perimeter at four locations, namely, the top and the bottom and the right and left sides, and all of these contact points or locations of edge abutment are curves.

The Figures described above show the yardline numbers 22 located on the left side of the field 10, with the arrow on the left. For those yardline numbers 22 located on the right side of the field (when viewed from either sideline, starting with the 40 yardline, and then proceeding to the 30, the 20, and then the 10 yardlines), the arrow template 40 will be used to locate the arrow to point toward the closest goal line, namely the goal line 16 on the right. Thus, the arrow template 40 also inverts with the frame 28 when the "0" is located, for proper locating of the field arrow template 40 next to the "0" yardline number.

Figure 10A:
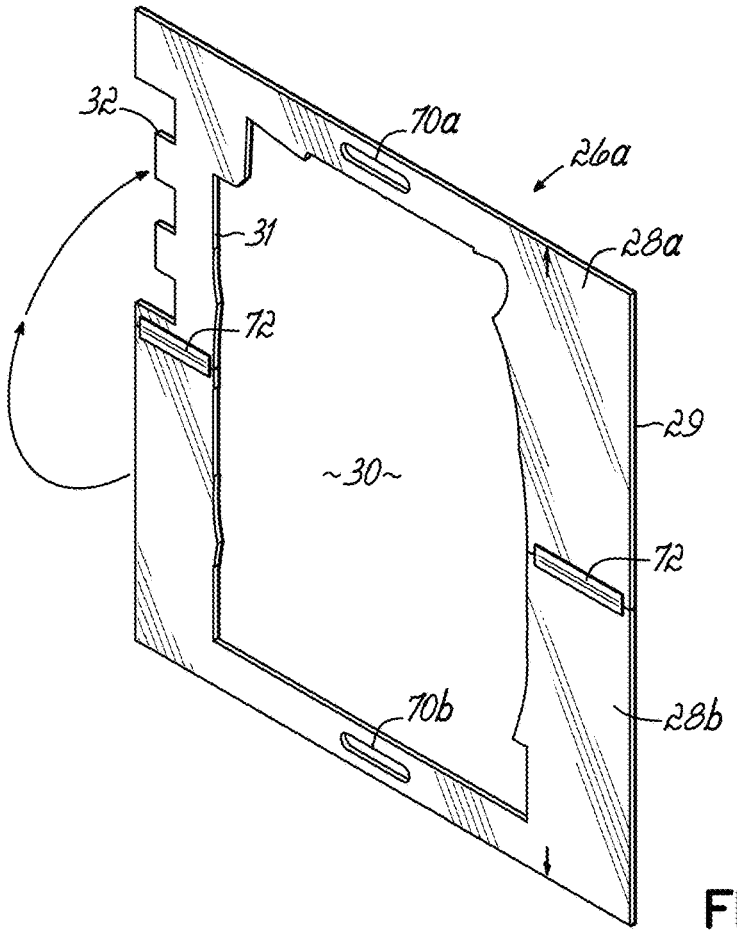
FIGS. 10A and 10B show the portability feature of the template shown in the other Figures.
Figure 10B:
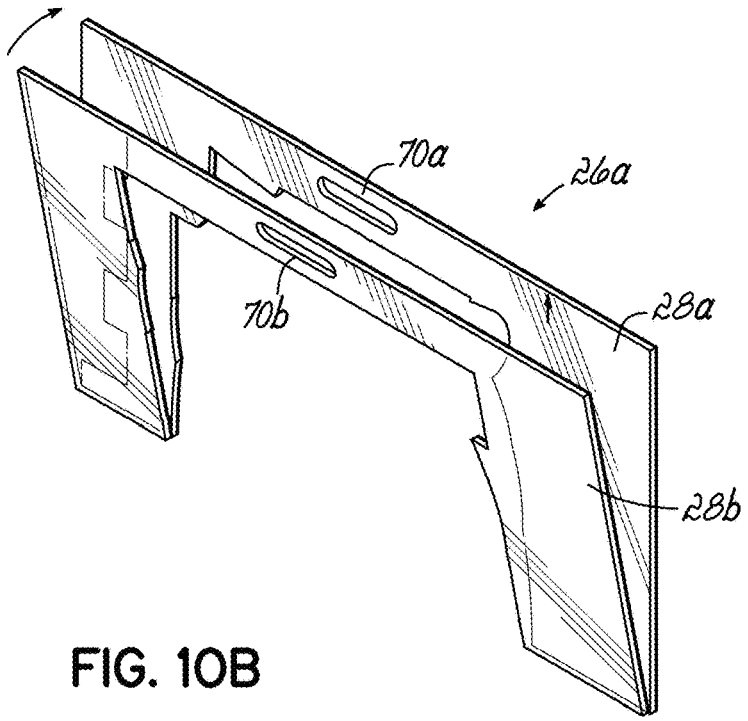

FIG. 10A shows the frame 28 configured with hinges 72 located along a hinge or fold line, thereby to define two hingable frame sections 28*a* and 28*b*, with the frame sections 28*a*, 28*b* including aligned openings 70*a*, 70*b* to define a handle to facilitate carrying to the next yardline. FIG. 10B shows the sections 28*a* and 28*b* being folded together.

The template 26 of the present invention does not change the actual pinning of the sideline numbers to the initially installed turf, or the cutting of the initially installed turf for removal. Nor does it change the manner in which the already-colored yardline numbers (typically made from colored fibers at the factory) are thereafter inserted into the cut portions of the initially installed field. Rather, the present invention simplifies the proper locating of the colored yardline numbers on the initially installed field. With one single template rather than six different number-specific templates, the field installation crew can mark the locations of all the yardline numbers of a football field in about half fewer hours than was previously required with multiple templates. Applicant estimates that using a single template reduces the man-hours for this step being about 50%.

The template of the present invention simplifies the process of properly locating the yardline numbers of a football field. More specifically, with the template of this invention the yardline numbers can be initially placed in the general areas of the field where they will be used. Then, once the temporary longitudinal lines have been marked, the installers can carry the template to the first yardline number location on one side of the field, such as the 10 yardline.

For example, the template can first be used to locate the "1" in the proper position and then the same template can be "flipped" over the yardline to be used to locate the "0" yardline number, in inverted form. As soon as the "1" and the "0" are pinned in the proper location and the arrow also pinned in place, the template can be moved to the next yardline. The process can continue along the sideline until all of the yardline numbers have been located. Thereafter, the installer moves to the opposite side of the field and repeats the same process.

The template of the present invention can be made from any one of a number of relatively lightweight and sturdy materials, but the template can also be flexible. Still further, it can also be made of rigid material and preferably hinged along a central axis, thereby to define two frame sections, as shown. And in that case, the frame sections preferably include aligned internal handles, to enhance portability.

Those skilled in the art will understand and appreciate that this specification explains the details of the present invention in the context of an exemplary embodiment, and that the exemplary embodiment is not intended to limit the scope of the present invention, or to be used to limit the scope of the following claims. For example, the present invention is particularly suitable for marking the yardline numbers of an American football field on an unfilled artificial turf. But the principle of the present invention could be applied to other sports, and also to other markings that are used on various athletic fields, other than numbers used for American football. Still further, the principle could be used on other types of athletic surfaces, not solely infilled artificial turf surfaces.

Further, those skilled in the art will also appreciate that the objects set forth in this specification are not intended to be construed as limitations. Rather, they are intended to provide the reader with a practical understanding of the various benefits achieved via certain aspects of the present invention, particularly according to the presently disclosed preferred embodiment. Moreover, each claim of this specification recites subject matter that applicant considers to be new, useful, and unobvious over the prior art, regardless of whether that recited subject matter achieves one or more of the above-described objects, or maybe even only partially achieves one or more of those objects. In other words, this specification explains the story of this invention, i.e. how it came to be, and why it represents an improvement over the existing state of the art. And as a result, applicant does not intend that each of the appended claims is required to achieve every one of the above-stated objects, and those skilled in the art will understand that.

I claim:

1. A template for properly locating, at one time, either one of at least two different yardline numbers on an artificial turf football field comprising:

a generally rectangular frame having an external perimeter and an internal opening defined by an internal perimeter, the internal perimeter shaped to identify a first plurality of locations for abutting a corresponding first plurality of outer edge portions of a first yardline number when the first yardline number is temporarily located within the opening, to locate the first yardline number in a first yardline number position on the artificial turf; and the internal perimeter also shaped to identify at least one additional plurality of locations for abutting at least one additional corresponding plurality of outer edge portions of a second different yardline number when the second yardline number is temporarily located within the opening, to locate the second yardline number in a second yardline number position on the artificial turf, the second yardline number position being different from the first yardline number position, so that the first plurality of locations for abutting the internal perimeter differs from the at least one additional plurality of locations for abutting the internal perimeter, whereby the frame has a size and a shape so as to be usable to properly locate, at one time, either the first yardline number or the second yardline number but not both at the same time.

2. The template of claim 1 wherein six different yardline numbers are used to mark the artificial turf football field, and further comprising:

for each of the six yardline numbers, the internal perimeter of the frame identifies a plurality of locations for abutting, at one time, a corresponding plurality of edge portions of any one but only one of the yardline numbers, such that the internal perimeter of the frame has six different pluralities of locations for abutting.

3. The template of claim 1 and further comprising:

the outer perimeter configured to locate an additional template for locating the position of a corresponding yardline arrow.

4. The template of claim 1 wherein the outer perimeter defines at least one edge for locating the template relative to at least one of: a yardline on the field and a temporary longitudinal line extending along the length of the field.

5. The template of claim 1 and further comprising:

a hinge line extending along the frame and defining two connected frame sections, the frame sections being foldable about the hinge line.

6. The template of claim 5 and further comprising:

a handle formed in the frame generally opposite the hinge line, thereby to facilitate carrying of the frame.

7. The template of claim 1 wherein the first yardline number is a "5," and there are 5 locations for abutting the 5 yardline number.

8. The template of claim 1 wherein the first yardline number is a "4" and there are 4 locations for abutting the 4 yardline number.

9. The template of claim 1 wherein the first yardline number is a "3" and there are 7 locations for abutting the 3 yardline number.

10. The template of claim 1 wherein the first yardline number is a "2" and there are 8 locations for abutting the 2 yardline number.

11. The template of claim 1 wherein the internal perimeter of the frame generally defines top and bottom sides and left and right sides for the internal opening, when viewed from an adjacent sideline of the football field, and further wherein a first yardline number is a "1" and there are 3 locations for abutting the 1 yardline number when the 1 yardline number is located on the left side of the opening.

12. The template of claim 1 wherein the first yardline number is a "0" and there are 4 locations for abutting the 0 yardline number.

13. The template of claim 2 wherein the internal perimeter of the frame is sized to accommodate yardline numbers that have a longitudinal dimension of about 6 feet, the longitudinal dimension being parallel to an adjacently located yardline on the artificial turf.

14. The template of claim 2 and further comprising:

the frame being of uniform thickness; and a hinge line extending along the frame and defining two hingedly connected frame sections, the frame sections being of uniform thickness, and the frame sections being foldable about the hinge line to a stacked relationship.

15. The template of claim 14 and further comprising:

each of the frame sections including an opening located opposite the hinge line, the openings of the two frame sections being aligned when the frame sections are in the stacked relationship so as to form a handle in the frame generally opposite the hinge line, thereby to facilitate carrying of the frame.

16. The template of claim 2 wherein the external perimeter comprises a pair of spaced parallel segments that are parallel with the orientation of each of the yardline numbers, wherein each of the parallel segments is alignable along a football yardline to properly locate the frame on the artificial turf.

17. A template for properly locating, at one time, any one of a plurality of different yardline numbers on an artificial turf football field comprising:

a generally rectangular frame having an external perimeter and an internal opening defined by an internal perimeter, the internal perimeter shaped to identify, for each of the different yardline numbers needed for properly marking a conventional football field with yardline numbers, a plurality of locations for abutting a corresponding plurality of outer edge portions of the corresponding yardline number when the corresponding yardline number is temporarily located within the opening, wherein each of the plurality of locations for abutting for any particular yardline number differs from the plurality of locations for abutting for all of the other yardline numbers, so that the internal perimeter of the frame defines a yardline number position for each yardline number and wherein all of the yardline number positions are different, such that the same frame may be used to properly locate, at one time, any one but only one of the plurality of different yardline numbers; and the external perimeter is also shaped to identify a location for an adjacently located arrow template.

18. The template of claim 17 and further comprising:

the frame being of uniform thickness; and a hinge line extending along the frame and defining two hingedly connected frame sections, the frame sections being of uniform thickness, and the frame sections being foldable about the hinge line to a stacked relationship.

19. The template of claim 18 and further comprising:

each of the frame sections including an opening located opposite the hinge line, the openings of the two frame sections being aligned when the frame sections are in the stacked relationship so as to form a handle in the frame generally opposite the hinge line, thereby to facilitate carrying of the frame.

20. The template of claim 17 wherein, for each of the different yardline numbers, the frame is marked with indicia to identify the locations for abutting corresponding edge portions of the yardline number.

21. The template of claim 17 wherein for each of the different yardline numbers, the plurality of locations for abutting includes at least one of:

a straight line, a curve, a corner, and a combination thereof.

22. The template of claim 17 wherein one of the yardline numbers is a "1" yardline number, and the internal perimeter of the frame generally defines top and bottom sides and left and right sides for the internal opening, when viewed from an adjacent sideline of the football field, such that the "1" yardline number is located on the left side in order to properly mark a yardline number "1" position.

23. The template of claim 22 wherein one of the yardline numbers is a "0" yardline number, and the "0" yardline number position is obtained by flipping the template over a yardline of the artificial turf football field that extends perpendicularly from the adjacent sideline thereof, such that the template resides on a right side of the yardline when properly locating the "0" yardline number and resides on a left side thereof when properly locating each of the other yardline numbers.

24. The template of claim 17 wherein each of the six yardline numbers has a dimension such that the internal perimeter of the frame is sized so as to accommodate the six different yardline numbers, and each of the six yardline numbers has a longitudinal dimension of about six feet, the longitudinal dimension being parallel to an adjacently located yardline on the artificial turf.

* * * * *